US005897396A

United States Patent [19]

Maejima

[11] Patent Number: 5,897,396

[45] Date of Patent: Apr. 27, 1999

[54] WATERPROOF RUBBER PLUG

[75] Inventor: Toshiro Maejima, Shizuoka-ken, Japan

[73] Assignee: Yazaki Corporation, Tokyo, Japan

[21] Appl. No.: 08/659,300

[22] Filed: Jun. 6, 1996

[30] Foreign Application Priority Data

Jun. 8, 1995 [JP] Japan ..... 7-141902

[51] Int. Cl.[6] ..... H01R 13/40

[52] U.S. Cl. ..... 439/587; 439/275

[58] Field of Search ..... 439/587, 589, 439/274, 275, 279

[56] References Cited

U.S. PATENT DOCUMENTS

| | | | |
|---|---|---|---|
| 4,565,417 | 1/1986 | Diissel et al. | 439/275 |
| 4,946,402 | 8/1990 | Fink et al. | 439/274 |
| 5,356,312 | 10/1994 | Abe et al. | 439/587 |

FOREIGN PATENT DOCUMENTS

| | | |
|---|---|---|
| 60-130066 | 7/1985 | Japan . |
| 61-117467 | 7/1986 | Japan . |
| 62-163879 | 10/1987 | Japan . |
| 3-182071 | 8/1991 | Japan . |

*Primary Examiner*—Steven L. Stephan
*Assistant Examiner*—T C Patel
*Attorney, Agent, or Firm*—Finnegan, Henderson, Farabow, Garrett & Dunner, L.L.P.

[57] ABSTRACT

A waterproof rubber plug has a through hole for allowing a pair of electrical wires to pass therethrough. the end of each of the electrical wires being electrically connected to a terminal. The waterproof rubber plug is inserted into a mounting hole formed in a connector housing for filling the gap between the outer periphery of each of the pair of electrical wires and the inner surface of the mounting hole of the connector housing. The through hole is divided into a pair of branch holes, each allowing the corresponding one of the pair of electrical wires to pass therethrough so as to tightly engage the outer periphery of each of the electric wires.

10 Claims, 5 Drawing Sheets

WATERPROOF RUBBER PLUG

BACKGROUND OF THE INVENTION

1. Field of the Invention

The present invention relates generally to a waterproof rubber plug for filling the gap between the outer surface of an electrical wire and the inner surface of a mounting hole of a connector housing.

2. Description of the Prior Art

One of conventional waterproof rubber plugs of this type is disclosed in Japanese Utility Model Laid-Open No. 62-163879.

In this waterproof rubber plug, a connector housing has a mounting hole for engaging a waterproof rubber plug of a substantially cylindrical shape. The waterproof rubber plug also has a through hole which extends along the longitudinal central axis of the waterproof rubber plug for engaging the outer surface of an electrical wire. The waterproof rubber plug comprises a thick-walled body portion for filling the gap between the outer surface of the electrical wire and the inner surface of the mounting hole of the connector housing, and a thin-walled clamped portion extending from an end of the body portion. The waterproof rubber plug is designed to fill the gap between the outer surface of the electrical wire and the inner surface of the mounting hole when it is inserted into the mounting hole of the connector housing.

A pair of inside annularly raised portions are so formed as to project from the inner surface of the through hole of the body portion at regular intervals in the longitudinal direction. The inside annularly raised portions cause the inner surface of the through hole to be a corrugated surface for tightly engaging the outer surface of the electrical wire. In addition, a plurality of outside annularly raised portions are so formed as to project from the outer surface of the body portion at regular intervals in the longitudinal direction. The outside annularly raised portions also cause the outer surface of the body portion to be a corrugated surface for tightly engaging the inner surface of the mounting hole of the connector housing.

The connector housing is designed to receive therein a wire connecting terminal. One end of the terminal is provided with a rubber-plug clamping piece. When the clamped portion of the waterproof rubber plug is clamped by the rubber-plug clamping piece, the waterproof rubber plug is secured to the electrical wire.

A flange portion extends radially from the outer periphery of the end portion of the clamped portion of the waterproof rubber plug. One end of the electrical wire is drawn out of the through hole at the flange portion. The drawn portion of the electrical wire serves as a connecting portion, in which the coating portion of the electrical is removed to expose the conducting portion thereof. The terminal is provided with a wire clamping portion. When the electrical wire is clamped by the wire clamping portion, the conducting portion of the connecting portion is electrically connected to the terminal.

According to such a waterproof rubber plug, it is possible to ensure the waterproof characteristic between the mounting hole of the connector housing and the electrical wire.

However, when a branch electrical wire is connected to a main electrical wire using such a conventional waterproof rubber plug, the coating portion must be stripped at an intermediate portion (a branch connecting portion) of the main electrical wire drawn out of the connector housing. In addition, in order to connect the branch electrical wire to the main electrical wire, both of the exposed conducting portion of the main electrical wire and the conducting portion of the branch electrical wire must be clamped by a joint terminal or the like. Moreover, the connecting portion of the main electrical wire must be clamped by the wire clampling portion of the terminal at another place. That is, two electrical connections must be performed.

In order to ensure the waterproof characteristic at the branch connecting portion, it is required to waterproof the branch connecting portion, for example, by binding a pair of tape-like members round the main and branch electrical wires on both sides of the branch connecting portion and by arranging the branch connecting portion within an insulating cover. The tape-like members must fill in the spaces between the outer surfaces of the main and branch electrical wires and the inner surface of the insulating cover. Such a structure is disclosed in Japanese Patent Laid-Open No. 60-130066.

That is, in such a conventional structure, the clamping and waterproofing of the electrical wires must be performed at two places, respectively. Therefore, there is a problem in that the wire connecting structure and assembly operation thereof are complicated. In addition, since the electrical connections are also performed at two places, there is a problem in that the reliability on the conductivity may be decreased by the electrical connections.

SUMMARY OF THE INVENTION

It is therefore an object of the present invention to eliminate the aforementioned problems and to provide a waterproof rubber plug which can improve the waterproof characteristic between a connector housing and an electrical wire, to which a branch electrical wire is connected.

It is another object of the present invention to provide a waterproof rubber plug which has a simple structure and which can improve the assembly operation and the reliability on the conductivity.

In order to accomplish the aforementioned and other objects, according to one aspect of the present invention, a waterproof rubber plug for filling a gap between a pair of electrical wires and a mounting hole formed in a connector housing, one end of each of the pair of electrical wires being electrically connected to a terminal received in the connector housing, the waterproof rubber plug comprising: a rubber plug body inserted into a mounting hole formed in a connector housing; and a through hole formed in the rubber plug body, the through hole passing through the rubber plug body for receivng a pair of electrical wires, one end of each of the pair of electrical wires being electrically connected to a terminal received in the connector housing, the through hole being divided at an intermediate portion of the rubber plug body into a pair of branch holes, so that one end face of the plug body has a single opening and the other end face thereof has a pair of openings.

In this waterproof rubber plug, a through hole for receiving a pair of electrical wires is divided into a pair of branch holes, each of which communicates with the through hole for receiving the corresponding one of the pair of electrical wires. Therefore, since the pair of electrical wires are bunched to be drawn out of the through hole at the front end of the waterproof rubber plug, it is possible to simply perform both the connection of the electrical wires to each other and the electrical connection of the electrical wires to a terminal at the same place. Therefore, it is sufficient to perform the waterproofing at a single place, and it is possible to simplify the waterproof structure and to improve the assembly operation. In addition, it is possible to improve the reliability on the conductivity between the electrical wires and the terminal. Moreover, since each of the branch holes engages the corresponding one of the pair of electrical wires, it is possible to surely fill the gap between each of the electrical wires and the corresponding one of the branch holes, so that the waterproof rubber plug can have a high waterproof performance.

In the aforementioned waterproof rubber plug, the rubber plug body may be provided with annular ribs, each projecting from the inner surface of each of the pair of branch holes for tightly engaging the outer periphery of each of the pair of electrical wires. In this case, it is possible to more surely fill the gap between each of the electrical wires and the corresponding one of the branch holes, so that the waterproof rubber plug can have a still higher waterproof performance.

In the aforementioned waterproof rubber plug, the rubber plug body may have a clamped portion which is clamped by an end portion of the terminal. In this case, when the clamped portion formed at the front end is clamped by the end portion of the terminal, the front end of the waterproof rubber plug is secured to the end portion of the terminal. Therefore, the terminal and the waterproof rubber plug can be simultaneously mounted in the connector housing, so that it is possible to provide a further improved assembly operation.

In the aforementioned waterproof rubber plug, the rubber plug body may be provided with an annular raised portion which projects from the outer periphery thereof for tightly engaging the inner surface of the mounting hole of the connector housing. In this case, it is possible to more surely fill the gap between the waterproof rubber plug and the connector housing, so that the waterproof rubber plug can have a still higher waterproof performance.

According to another aspect of the present invention, a waterproof rubber plug for filling a gap between a plurality of electrical wires and a mounting hole formed in a connector housing, one end of each of the plurality of electrical wires being electrically connected to a terminal received in the connector housing, the waterproof rubber plug comprising: a rubber plug body inserted into a mounting hole formed in a connector housing; and a through hole formed in the rubber plug body, the through hole passing through the rubber plug body for receivng a plurality of electrical wires, one end of each of the plurality of electrical wires being electrically connected to a terminal received in the connector housing, the through hole being divided at an intermediate portion of the rubber plug body into a plurality of branch holes, so that one end face of the plug body has a single opening and the other end face thereof has a plurality of openings.

In this waterproof rubber plug, a through hole for receiving a plurality of electrical wires is divided into a plurality of branch holes, each of which communicates with the through hole for receiving the corresponding one of the plurality of electrical wires. Therefore, since the plurality of electrical wires are bunched to be drawn out of the through hole at the front end of the waterproof rubber plug, it is possible to simply perform both the connection of the electrical wires to each other and the electrical connection of the electrical wires to a terminal at the same place. Therefore, it is sufficient to perform the waterproofing at a single place, and it is possible to simplify the waterproof structure and to improve the assembly operation. In addition, it is possible to improve the reliability on the conductivity between the electrical wires and the terminal. Moreover, since each of the branch holes engages the corresponding one of the plurality of electrical wires, it is possible to surely fill the gap between each of the electrical wires and the corresponding one of the branch holes, so that the waterproof rubber plug can have a high waterproof performance.

In the aforementioned waterproof rubber plug, the rubber plug body may be provided with annular ribs, each projecting from the inner surface of each of the plurality of branch holes for tightly engaging the outer periphery of each of the plurality of electrical wires. The rubber plug body may also have a clamped portion which is clamped by an end portion of the terminal. The rubber plug body may also have an annular raised portion which projects from the outer periphery thereof for tightly engaging the inner surface of the mounting hole of the connector housing.

According to further aspect of the present invention, a waterproof rubber plug inserted into a mounting hole formed in a connector housing for filling a gap between the outer periphery of each of a pair of electrical wires and the inner surface of the mounting hole of the connector housing, comprises: a first portion having a front end which is first inserted into a mounting hole formed in a connector housing, the first portion having a through hole for allowing a pair of electrical wires to pass therethrough, an end of each of the pair of electrical wires being electrically connected to a terminal; and a second portion integrally formed with the first portion and having a rear end opposite to the front end, the second portion having a pair of branch holes, each of which communicates with the through hole for allowing each of the pair of electrical wires to pass therethrough, so that the second portion has a pair of openings in the rear end relative to a single opening formed in the front end of the first portion.

In this waterproof rubber plug, a through hole for receiving a pair of electrical wires is divided into a pair of branch holes, each of which communicates with the through hole for receiving the corresponding one of the pair of electrical wires. Therefore, since the pair of electrical wires are bunched to be drawn out of the through hole at the front end of the waterproof rubber plug, it is possible to simply perform both the connection of the electrical wires to each other and the electrical connection of the electrical wires to a terminal at the same place. Therefore, it is sufficient to perform the waterproofing at a single place, and it is possible to simplify the waterproof structure and to improve the assembly operation. In addition, it is possible to improve the reliability on the conductivity between the electrical wires and the terminal. Moreover, since each of the branch holes engages the corresponding one of the pair of electrical wires, it is possible to surely fill the gap between each of the electrical wires and the corresponding one of the branch holes, so that the waterproof rubber plug can have a high waterproof performance.

In the aforementioned waterproof rubber plug, the second portion may be provided with annular ribs, each projecting from the inner surface of each of the pair of branch holes for tightly engaging the outer periphery of each of the pair of electrical wires. In this case, it is possible to more surely fill the gap between each of the electrical wires and the corresponding one of the branch holes, so that the waterproof rubber plug can have a still higher waterproof performance.

In the aforementioned waterproof rubber plug, the first portion may have a clamped portion which is clamped by an end portion of the terminal. In this case, when the clamped portion formed at the front end is clamped by the end portion of the terminal, the front end of the waterproof rubber plug is secured to the end portion of the terminal. Therefore, the terminal and the waterproof rubber plug can be simultaneously mounted in the connector housing, so that it is possible to provide a further improved assembly operation.

In the aforementioned waterproof rubber plug, the second portion may be provided with an annular raised portion which projects from the outer periphery thereof for tightly engaging the inner surface of the mounting hole of the connector housing. In this case, it is possible to more surely fill the gap between the waterproof rubber plug and the connector housing, so that the waterproof rubber plug can have a still higher waterproof performance.

Accoding to still further aspect of the present invention, a waterproof rubber plug inserted into a mounting hole formed in a connector housing for filling a gap between the outer periphery of each of a plurality of electrical wires and the inner surface of the mounting hole of the connector housing, comprises: a first portion having a front end which is first inserted into a mounting hole formed in a connector housing, the first portion having a through hole for allowing a plurality of electrical wires to pass therethrough, an end of each of the plurality of electrical wires being electrically connected to a terminal; and a second portion integrally formed with the first portion and having a rear end opposite to the front end, the second portion having a plurality of branch holes, each of which communicates with the through hole for allowing each of the plurality of electrical wires to pass therethrough, so that the second portion has a plurality of openings in the rear end relative to a single opening formed in the front end of the first portion.

In this waterproof rubber plug, a through hole for receiving a plurality of electrical wires is divided into a plurality of branch holes, each of which communicates with the through hole for receiving the corresponding one of the plurality of electrical wires. Therefore, since the plurality of electrical wires are bunched to be drawn out of the through hole at the front end of the waterproof rubber plug, it is possible to simply perform both the connection of the electrical wires to each other and the electrical connection of the electrical wires to a terminal at the same place. Therefore, it is sufficient to perform the waterproofing at a single place, and it is possible to simplify the waterproof structure and to improve the assembly operation. In addition, it is possible to improve the reliability on the conductivity between the electrical wires and the terminal. Moreover, since each of the branch holes engages the corresponding one of the plurality of electrical wires, it is possible to surely fill the gap between each of the electrical wires and the corresponding one of the branch holes, so that the waterproof rubber plug can have a high waterproof performance.

In the aforementioned waterproof rubber plug, the second portion may be provided with annular ribs, each projecting from the inner surface of each of the plurality of branch holes for tightly engaging the outer periphery of each of the plurality of electrical wires. The first portion may also have a clamped portion which is clamped by an end portion of the terminal. The second portion may also have an annular raised portion which projects from the outer periphery thereof for tightly engaging the inner surface of the mounting hole of the connector housing.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENT

Referring now to the accompanying drawings, particularly to FIGS. 1 through 5, the first preferred embodiment of a waterproof rubber plug, according to the present invention, will be described below.

Figure 1:
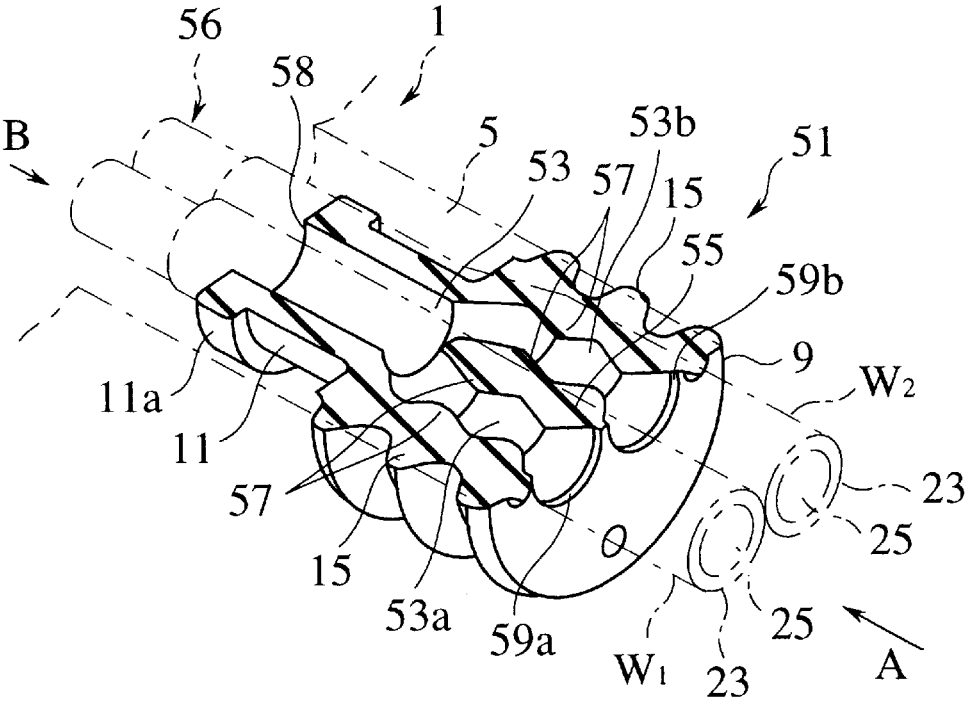
FIG. 1 is a sectional and perspective veiw of the first preferred embodiment of a waterproof rubber plug according to the present invention.
Figure 2:
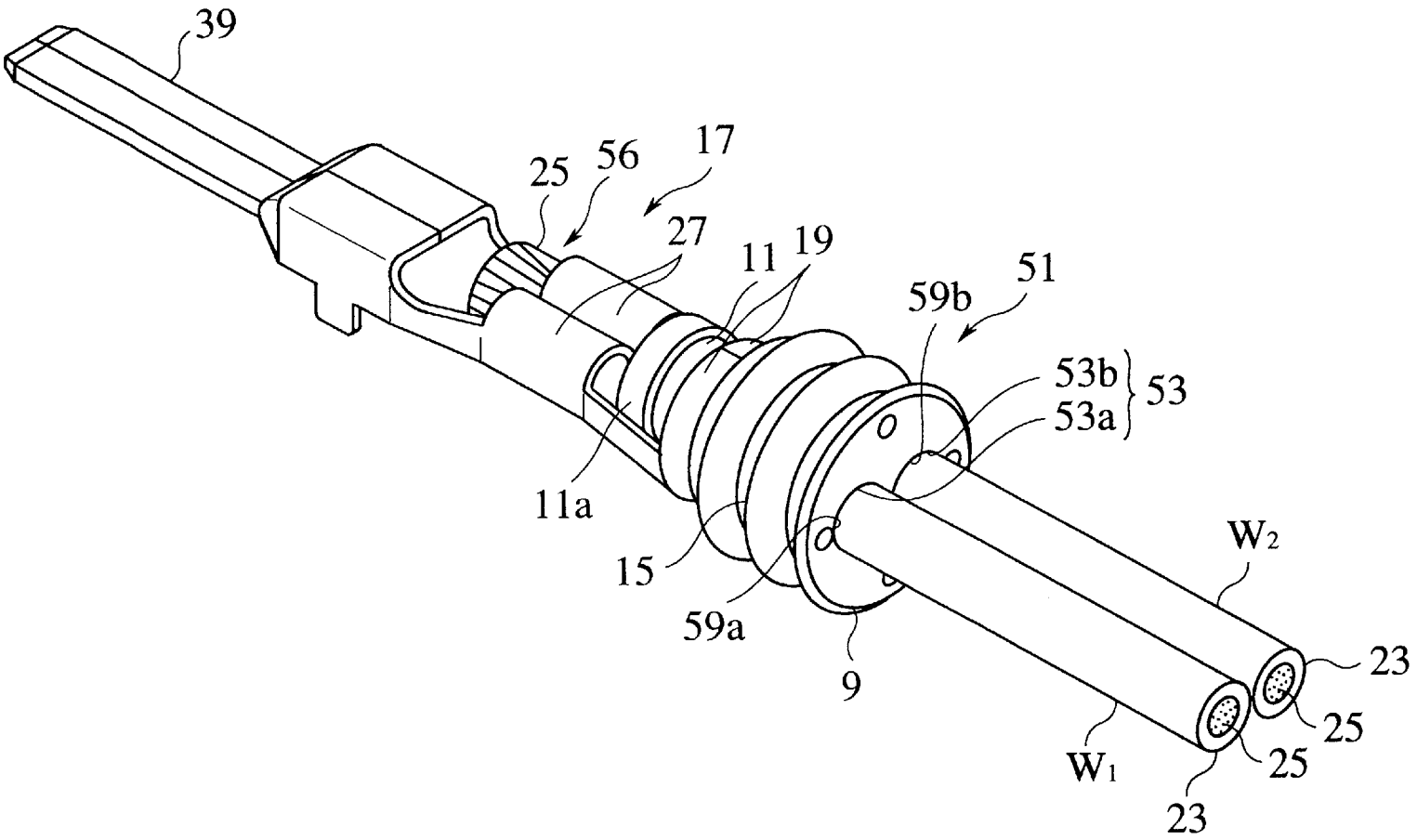
FIG. 2 is a perspective view of the waterproof rubber plug of FIG. 1, wherein the waterproof rubber plug receiving electrical wires is connected to a terminal.
Figure 3:
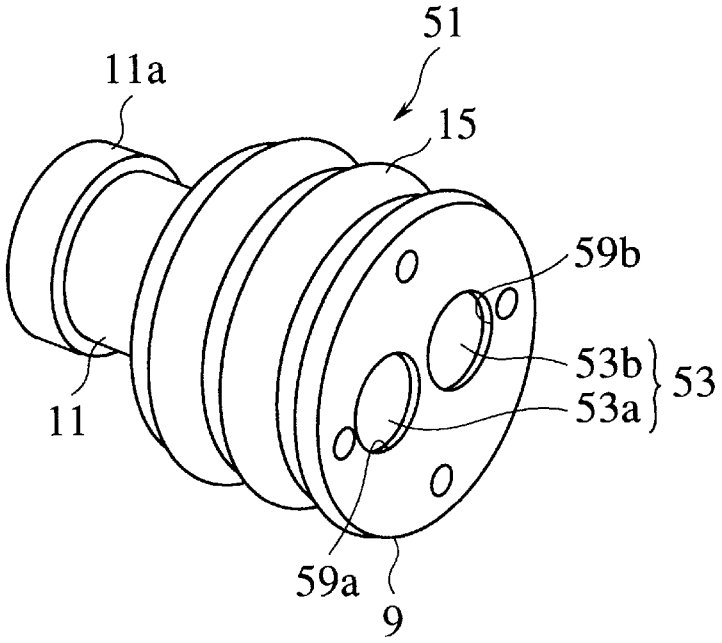
FIG. 3 is a perspective view of the waterproof rubber plug of FIG. 1, viewed along arrow A in FIG. 1.
Figure 4:
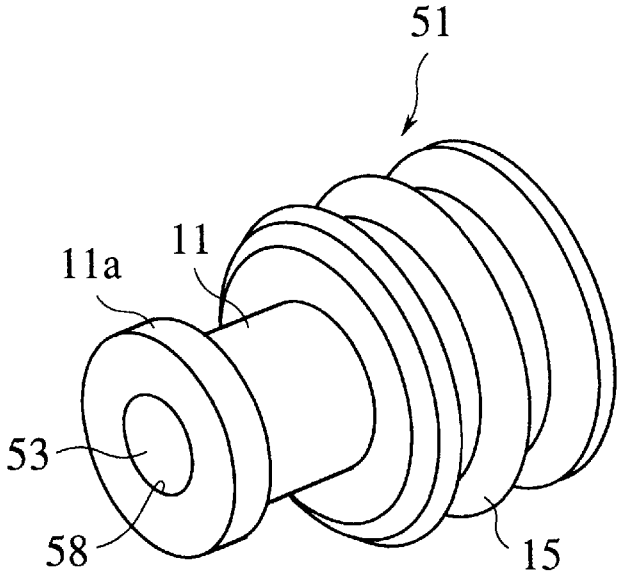
FIG. 4 is a perspective view of the waterproof rubber plug of FIG. 1, viewed along arrow B in FIG. 1.
Figure 5:
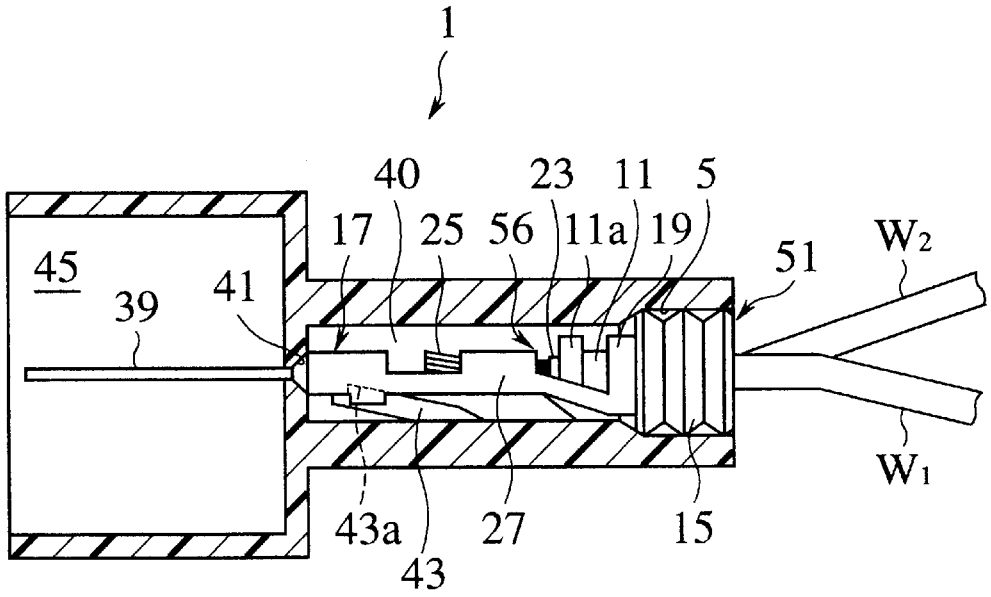
FIG. 5 is a sectional view of a connector housing which receives therein the waterproof rubber plug of FIG. 1.

FIG. 1 is a sectional and perspective veiw of the first preferred embodiment of a waterproof rubber plug according to the present invention, and FIG. 2 is a perspective view of the waterproof rubber plug of FIG. 1, wherein the waterproof rubber plug receiving electrical wires are connected to a terminal. FIG. 3 is a perspective view of the waterproof rubber plug of FIG. 1, viewed along arrow A in FIG. 1, and FIG. 4 is a perspective view of the waterproof rubber plug of FIG. 1, viewed along arrow B in FIG. 1. In addition, FIG. 5 is a sectional view of a connector housing which receives therein the waterproof rubber plug of FIG. 1;

As shown in FIG. 1, a connector housing 1 has an mounting hole 5 into which a waterproof rubber plug 51 is inserted for engaging therewith. The waterproof rubber plug 51 has a through hole 53 extending in a longitudinal direction thereof. A pair of electrical wires W1 and W2 are inserted into the through hole 53 for engaging therewith. The waterproof rubber plug 51 comprises a thick-walled body portion 9 for filling the gap between the outer surfaces of the electrical wires W1, W2 and the inner surface of the inserting hole 5 of the connector housing 1, and a thin-walled clamped portion 11 integrally formed with the body portion 9 so as to extend from the front end of the body portion 9. The clamped portion 11 is arranged on the front end side which is first inserted into the inserting hole 5, and the body portion 9 is arranged on the rear end side opposite to the front end side.

The mounting hole 5 is bifurcated within the waterproof rubber plug 51 so that the waterproof rubber plug 51 has an opening 58 at the front end side, and two openings 59*a* and 59*b* at the rear end side (see FIGS. 3 and 4). The body portion 9 is provided with a dividing wall portion 55 for dividing the through hole 53 into two branch holes 53*a* and 53*b*. Each of the electrical wires W1 and W2 passes through the corresponding one of the branch holes 53*a* and 53*b*. The body portion 9 is formed with annular waterproof ribs 57 which are so arranged as to project from the inner surface of the branch holes 53*a* and 53*b* at regular intervals in the longitudinal direction. The annular waterproof ribs 57 are configured so that the inner surface of each of the branch holes 53*a* and 53*b* is a corrugated surface for tightly engaging the outer surface of each of the electrical wires W1 and W2. The body portion 9 is also formed with outside annularly raised portions 15 which are so arranged as to project from the outer surface thereof at regular intervals in the longitudinal direction. The outside annularly raised portions 15 are configured so that the outer surface of the body portion 9 is a corrugated surface for tightly engaging the inner surface of the mounting hole 5.

As shown in FIG. 2, an electrical-wire connecting terminal 17 has a rubber-plug clamping piece 19 at the rear end thereof, an electrical-wire clamping piece 27 at an intermediate portion thereof, and a male terminal portion 39 at the front end thereof. When the clamped portion 11 of the waterproof rubber plug 51 is clamped by the rubber-plug clamping piece 19, the waterproof rubber plug 51 is secured to the electrical wires W1 and W2, and the terminal 17 is secured to the front end of the waterproof rubber plug 51.

The front end of the clamped portion 11 of the waterproof rubber plug 51 is formed with a flange portion 11*a* for preventing the rubber-plug clamping piece 19 from being drawn out of the clamped portion 11. The pair of electrical wires W1 and W2 are bunched to be drawn out of the single opening 58 (see FIG. 4) at the flange portion 11*a*. At a terminal connecting portion 56 arranged at the front end portion of the terminal 17, a coating portion 23 is removed from the electrical wires W1 and W2 so that a conducting portion 25 is exposed. When the exposed conducting portion 25 is clamped by the electrical-wire clamping piece 27 of the terminal 17, the conducting portion is electrically connected to terminal 17 at the terminal connecting portion 56, and the terminal 17 is secured to the front ends of the pair of electrical wires W1 and W2.

As shown in FIG. 5, the connector housing 1 comprises a terminal chamber 40 communicating with the mounting hole 5, a resilient engaging arm 43 projecting within the terminal chamber 40, and a male-connector engaging portion 45. The terminal 17 is inserted into the terminal chamber 40 through the mounting hole 5. The engaging arm 43 is formed with an engaging projection 43*a* which projects from the end of the engaging arm 43 for engaging an engaging hole (not shown) of the terminal 17 to prevent the terminal 17 from being drawn out of the connector housing 1. A through opening 41 is formed in a wall between the terminal chamber 40 and the male-connector engaging portion 45 so that the male terminal portion 38 passes through the through opening 41 to project within the male-connector engaging portion 45.

With this construction, the operation of the preferred embodiment of a waterproof rubber plug, according to the present invention, will be described below.

First, a pair of electrical wires W1 and W2 to be connected to each other are inserted into the through hole 53 of the waterproof rubber plug 51. In this case, the electrical wires W1 and W2 are engaged with the branch holes 53*a* and 53*b* so that each of the electrical wires W1 and W2 is drawn out of the corresponding one of the openings 59*a* and 59*b* on the rear end side of the waterproof rubber plug 51. The terminal connecting portion of the bunched electrical wires W1 and W2 is drawn out of the opening 58 on the front end side of the waterproof rubber 51. When the electrical wires W1 and W2 pass through the openings 58, 59*a* and 59*b*, the waterproof ribs 57 are elastically deformed to tightly engage the outer peripheries of the electrical wires W1 and W2 so as to fill the gap between the outer peripheries of the electrical wires W1, W2 and the inner surface of the through hole 53.

Next, the coating portions 23 of the electrical wires W1 and W2 are removed at the terminal connecting portion 56 to expose the conducting portions 25. The exposed conducting portions 25 are clamped by the electrical-wire clamping piece 27 of the terminal 17, and the clamped portion 11 of the waterproof rubber plug 51 is clamped by the rubber-plug clamping piece 19. The clamping by the electrical-wire clamping piece 27 causes the pair electrical wires W1 and W2 to be connected to each other at the terminal connecting portion 56. At this time, the conducting portion 25 is electrically connected to the terminal 17, and the terminal 17 is secured to the ends of the electrical wires W1 and W2. In addition, the clamping by the rubber-plug clamping piece 19 causes the clamped portion 11 to be fastened. At this time, the waterproof rubber plug 51 is secured to the electrical wires W1 and W2, and the terminal 17 is secured to the end of the waterproof rubber plug 51.

Finally, the male terminal portion 39 of the terminal 17 is inserted into the connector housing 1 through the mounting hole 5. Then, the waterproof rubber plug 51 is pressingly inserted into the mounting hole 5. As a result, the outside annularly raised portion 15 of the waterproof rubber plug 51 is elastically deformed to tightly engage the mounting hole 5 so as to fill the gap between the outer surface of the waterproof rubber plug 51 and the inner surface of the mounting hole 5.

In addition, when the waterproof rubber plug 51 is inserted into the mounting hole 5, the male terminal portion 39 projects within the male-connector engaging portion 45 through the through opening 41, and the engaging projection 43*a* of the engaging arm 43 engages the engaging hole (not shown), so that the terminal 17 is received and held in the terminal chamber 40.

As mentioned above, according to this preferred embodiment of the present invention, it is possible to simultaneously perform the connection of the electrical wires W1 and W2 to each other and the electrical connection of the electrical wires W1, W2 to the terminal 17, by clamping the exposed conducting portion 25 by means of the electrical-wire clamping piece 27 at the electrical-wire connecting portion 56 wherein the pair of electrical wires W1 and W2 are bunched. Therefore, it is sufficient to perform the waterproofing at only a single place, and it is possible to simplify the electrical-wire connecting structure and to improve the assembling operation thereof.

In addition, since the connection of the electrical wires W1 and W2 to each other and the electrical connection of the electrical wires W1, W2 to the terminal 17 can be performed at a single place, it is possible to improve the reliability on the conductivity between the electrical wires W1, W2 and the terminal 17, in comparison with the conventional manner for separately performing the connection of a plurality of electrical wire to each other and the electrical connection of the electrical wire to a terminal.

In addition, the through hole 53 is branched into the two branch holes 53*a* and 53*b* at the rear end side thereof, and the electrical wires W1 and W2 on the front end side is also branched on the rear end side so that the outer surface of each of the pair of electrical wires W1 and W2 engages the inner surface of the corresponding one of the branch holes 53*a* and 53*b*. Therefore, it is possible to surely fill the gap between the outer surface of each of the pair of electrical wires W1, W2 and the inner surface of the through hole 53, and it is possible to ensure a high waterproof characteristic between the electrical wires W1, W2 and the mounting hole 5 of the connecting housing 1.

In addition, the waterproof rib 57 projects from the inner surface of each of the branch holes 53*a* and 53*b*. Therefore, it is possible to more surely fill the gap between the outer surface of each of the electrical wires W1, W2 and the inner surface of the through hole 53, and it is possible to obtain a still higher waterproof characteristic.

Moreover, after the clamped portion 11 is clamped by the rubber-plug clamping piece 19 and after the electrical wires W1, W2 and the terminal 17 are secured to the waterproof rubber plug 51, the waterproof rubber plug 51 is inserted into the mounting hole 5 of the connector housing 1. Therefore, the terminal 17 and the waterproof rubber plug 51 can be simultaneously mounted on the connector housing 1, so that it is possible to improve the assembly operation.

While the through hole 53 has been divided into two branch holes 53*a* and 53*b* in order to connect a pair electrical wires W1 and W2 to each other in this embodiment, it is possible to obtain the same functions and advantaneous effects as those of this preferred embodiment regardless of the number of the electrical wires by dividing the through hole 53 into branch holes of the number which is the same as that of the electrical wires to be connected to each other.

Figure 6:
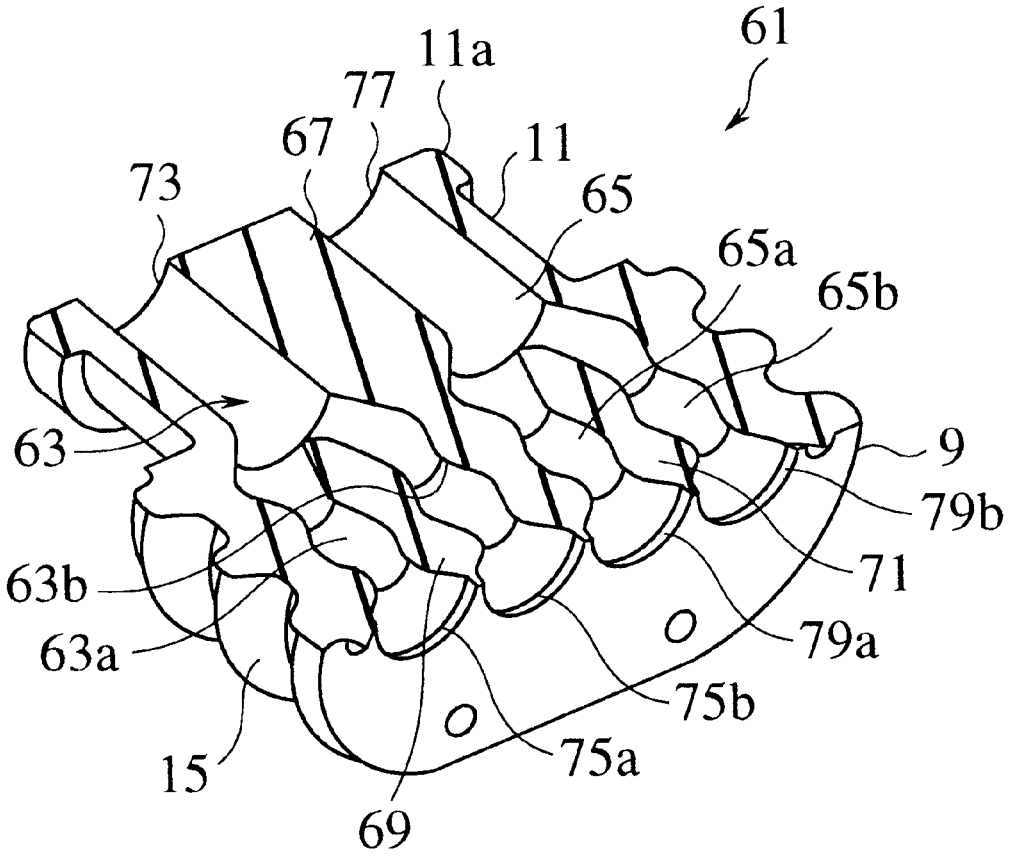
FIG. 6 is a sectional and perspective view of the second preferred embodiment of a waterproof rubber plug according to the present invention.

FIG. 6 shows the second preferred embodiment of a waterproof rubber plug 61 according to the present invention.

The waterproof rubber plug 61 has two separate through holes 63 and 65 which are separated by a partition wall portion 67. Each of the through holes 63 and 65 is divided into two branch holes 63*a* and 63*b* or 65*a* and 65*b*, so as to have a single opening 73 or 77 on the front end side and two openings 75*a* and 75*b* or 79*a* and 79*b* on the rear end side. Other constructions are the same as those of the first preferred embodiment.

According to this preferred embodiment, it is possible to obtain the same functions and advantaneous effects as those of the first preferred embodiment by a single waterproof rubber plug 61 when each of a pair of electrical wires is connected to the corresponding one of a pair of terminal received in a connector housing.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A waterproof connector assembly comprising:

a connector housing;

a terminal provided in the connector housing;

a rubber plug body inserted into a mounting hole formed in the connector housing;

a through hole formed in the rubber plug body, said through hole passing through the rubber plug body, said through hole being divided at an intermediate portion of the rubber plug body into a pair of branch holes, so that one end face of the plug body has a single opening and the other end face thereof has a pair of openings; and a pair of electrical wires, a first portion of one wire disposed in one branch hole and a first portion of the other wire disposed in the other branch hole, and second portions of both wires disposed in the through hole, wherein ends of the pair of electrical wires electrically connect to each other at the terminal in the connector housing spaced away from the rubber plug body.

2. A waterproof connector assembly as set forth in claim 1, wherein said rubber plug body is provided with annular ribs, each projecting from the inner surface of each of said pair of branch holes for tightly engaging the outer periphery of each of said pair of electrical wires.

3. A waterproof connector assembly as set forth in claims 1 or 2, wherein said rubber plug body has a clamped portion which is clamped by an end portion of said terminal.

4. A waterproof connector assembly as set forth in claim 1, wherein said rubber plug body is provided with an annular raised portion which projects from the outer periphery thereof for tightly engaging the inner surface of said mounting hole of said connector housing.

5. A waterproof connector assembly as set forth in claim 2, wherein said rubber plug body is provided with an annular raised portion which projects from the outer periphery thereof for tightly engaging the inner surface of said mounting hole of said connector housing.

6. A waterproof connector assembly comprising:

a connector housing;

a terminal provided in the connector housing;

a rubber plug body inserted into a mounting hole formed in the connector housing;

a through hole formed in the rubber plug body, said through hole passing through the rubber plug body, said through hole being divided at an intermediate portion of the rubber plug body into a plurality of branch holes, so that one end face of the plug body has a single opening and the other end face thereof has a plurality of openings; and a plurality of electric wires, wherein a first portion of each of the plurality of electric wires is disposed in respective ones of the plurality of branch holes, and a second portion of each of the plurality of electric wires is disposed in the through hole, and wherein ends of the plurality of electric wires are connected to each other at the terminal in the connector housing spaced away from the rubber plug body.

7. A waterproof connector assembly as set forth in claim 6, wherein said rubber plug body is provided with annular ribs, each projecting from the inner surface of each of said plurality of branch holes for tightly engaging the outer periphery of each of said plurality of electrical wires.

8. A waterproof connector assembly as set forth in claims 6 or 7, wherein said rubber plug body has a clamped portion which is clamped by an end portion of said terminal.

9. A waterproof connector assembly as set forth in claim 6, wherein said rubber plug body is provided with an annular raised portion which projects from the outer periphery thereof for tightly engaging the inner surface of said mounting hole of said connector housing.

10. A waterproof connector assembly as set forth in claim 7, wherein said rubber plug body is provided with an annular raised portion which projects from the outer periphery thereof for tightly engaging the inner surface of said mounting hole of said connector housing.

* * * * *